US006102679A

United States Patent [19]

Brown

[11] Patent Number: 6,102,679

[45] Date of Patent: Aug. 15, 2000

[54] AIR COMPRESSOR

[76] Inventor: Gerald E. Brown, 1317 N. 138th St., Omaha, Nebr. 68154

[21] Appl. No.: 09/041,346

[22] Filed: Mar. 12, 1998

[51] Int. Cl.[7] ..... F04B 11/00; F15B 11/08

[52] U.S. Cl. ..... 417/550; 91/422

[58] Field of Search ..... 417/313, 360, 417/415, 550, 569, 237; 137/565.17, 565.18; 91/922; 92/181, 182, 183

[56] References Cited

U.S. PATENT DOCUMENTS

| | | | |
|---|---|---|---|
| 277,305 | 5/1883 | Maltby | 92/183 |
| 2,792,790 | 5/1957 | Capps | 417/550 |
| 3,765,180 | 10/1973 | Brown | 60/370 |
| 4,106,463 | 8/1978 | Curtis, Jr. et al. | 123/193 |
| 4,240,644 | 12/1980 | Busto | 277/194 |
| 4,391,568 | 7/1983 | Tenney | 417/237 |

*Primary Examiner*—Henry C. Yuen
*Assistant Examiner*—Mahmoud M Gimie
*Attorney, Agent, or Firm*—Koley Jessen, P.C.; Mark D. Frederiksen

[57] ABSTRACT

The air compressor of the present invention includes an air storage tank with a hollow cylinder having a closed lower end mounted in the upper wall of the tank, so as to project within the interior of the tank. A drive motor mounted on the tank has a piston rod connected thereto and extending downwardly into the hollow cylinder, to reciprocate therein and pump air into the tank. The piston rod has an enlarged head slidably mounted within the cylinder, and an aperture formed through the piston rod head with an operable valve, to permit air flow into the cylinder, but prevent air flow out of the cylinder through the piston rod head aperture. An intake port with an operable valve is formed in the closed lower end of a hollow cylinder, to permit air flow into the tank but prevent air flow out of the tank. An exhaust port formed in the tank may be connected to a hose or other items as desired, to provide compressed air.

24 Claims, 3 Drawing Sheets

AIR COMPRESSOR

TECHNICAL FIELD

The present invention relates generally to air compressors, and more particularly to an improved air compressor with a modified cylinder and piston arrangement, and an improved exhaust manifold.

BACKGROUND OF THE INVENTION

The air compressor industry has been substantially stagnant in new product development for the last five to ten years. The last product development in the field which can be considered "innovative" would be the oil-less compressors introduced in the mid 1980's. While a major quality difference exists among the major manufacturers, the compressors themselves are essentially indistinguishable from one another in appearance and function. In general, each prior art air compressor includes a three piece cylindrical tank, a motor mounted on a saddle which is welded to the tank, and an upwardly projecting cylinder with a piston rod connected at a lower end to an eccentric driven by the motor. The upper end of the cylinder has an exhaust port which is connected by hose or pipe to an intake port on the tank, to provide compressed air to the tank.

These prior art compressors suffer several drawbacks. First, the cylindrical three piece tank requires two separate welding operations to form the tank, and further requires that saddles and other attachment pieces be welded to the tank in order to mount the motor and other equipment on the tank. Thus, the tank can be labor intensive to manufacture.

A second problem with prior art compressors is in the orientation of the cylinder and piston rod. In order to create a low profile for the overall compressor, the piston rod is necessarily of short length, such that the upper exhaust end of the cylinder does not project above the motor housing any farther than absolutely necessary. While the shorter piston rod provides a lower compressor profile, it also results in greater angles of piston operation and reduced efficiency due to necessary head clearances.

SUMMARY OF THE INVENTION

It is therefore a general object of the present invention to provide an improved air compressor, which is more efficient, and less costly to manufacture.

A further object is to provide an improved air compressor with a greater piston rod length than conventional compressors, but with a lower profile than conventional compressors.

Another object of the present invention is to provide an improved air compressor which is simple and economical to manufacture and refined in appearance.

These and other objects of the present invention will be apparent to those skilled in the art.

The air compressor of the present invention includes an air storage tank with a hollow cylinder having a closed lower end mounted in the upper wall of the tank, so as to project within the interior of the tank. A drive motor mounted on the tank has a piston rod connected thereto and extending downwardly into the hollow cylinder, to reciprocate therein and pump air into the tank. The piston rod has an enlarged head slidably mounted within the cylinder, and an aperture formed through the piston rod head with an operable valve, to permit air flow into the cylinder, but prevent air flow out of the cylinder through the piston rod head aperture. An intake port with an operable valve is formed in the closed lower end of a hollow cylinder, to permit air flow into the tank but prevent air flow out of the tank. An exhaust port formed in the tank may be connected to a hose or other items as desired, to provide compressed air.

DESCRIPTION OF THE PREFERRED EMBODIMENT

Figure 1:
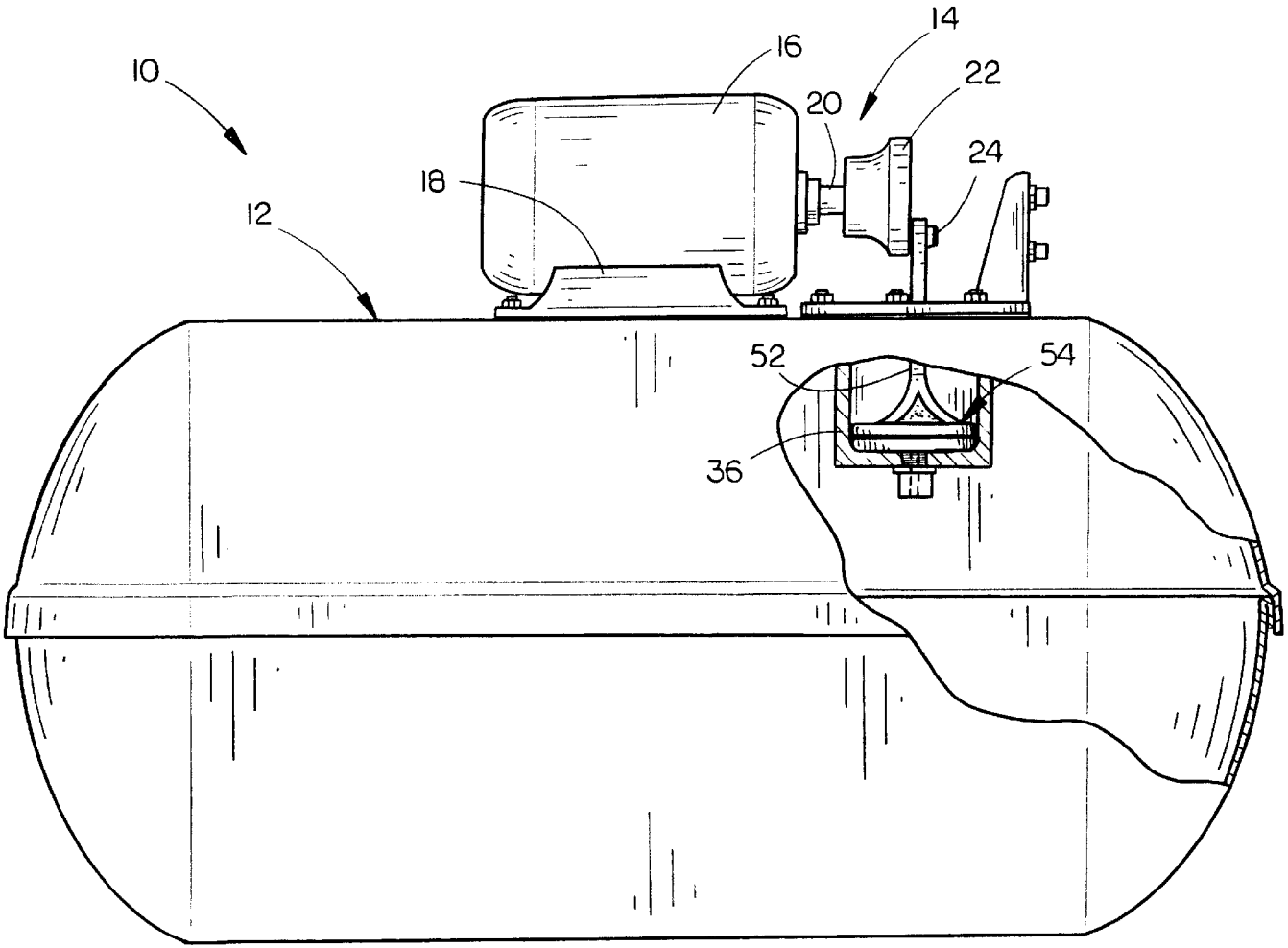
FIG. 1 is a side elevational view of the air compressor of the present invention, with a portion of the tank cut away to show the interior thereof.

Referring now to the drawings, in which similar or corresponding parts are identified with the same reference numeral, and more particularly to FIG. 1, the air compressor of the present invention is designated generally at 10 and includes a tank 12, for storage of compressed air, and an air pump 14 for pumping air into tank 12.

Air pump 14 includes a motor 16 secured on a base 18, with a drive shaft 20 projecting out forward end of the motor 16. Drive shaft 20 has a generally disk shaped eccentric 22 mounted on the free end thereof, for rotation with drive shaft 20. Eccentric 22 has a pin 24 projecting forwardly therefrom, having a longitudinal axis parallel to the axis of the drive shaft and spaced radially therefrom, so as to rotate in a circle about the longitudinal axis of drive shaft 20.

Figure 2:
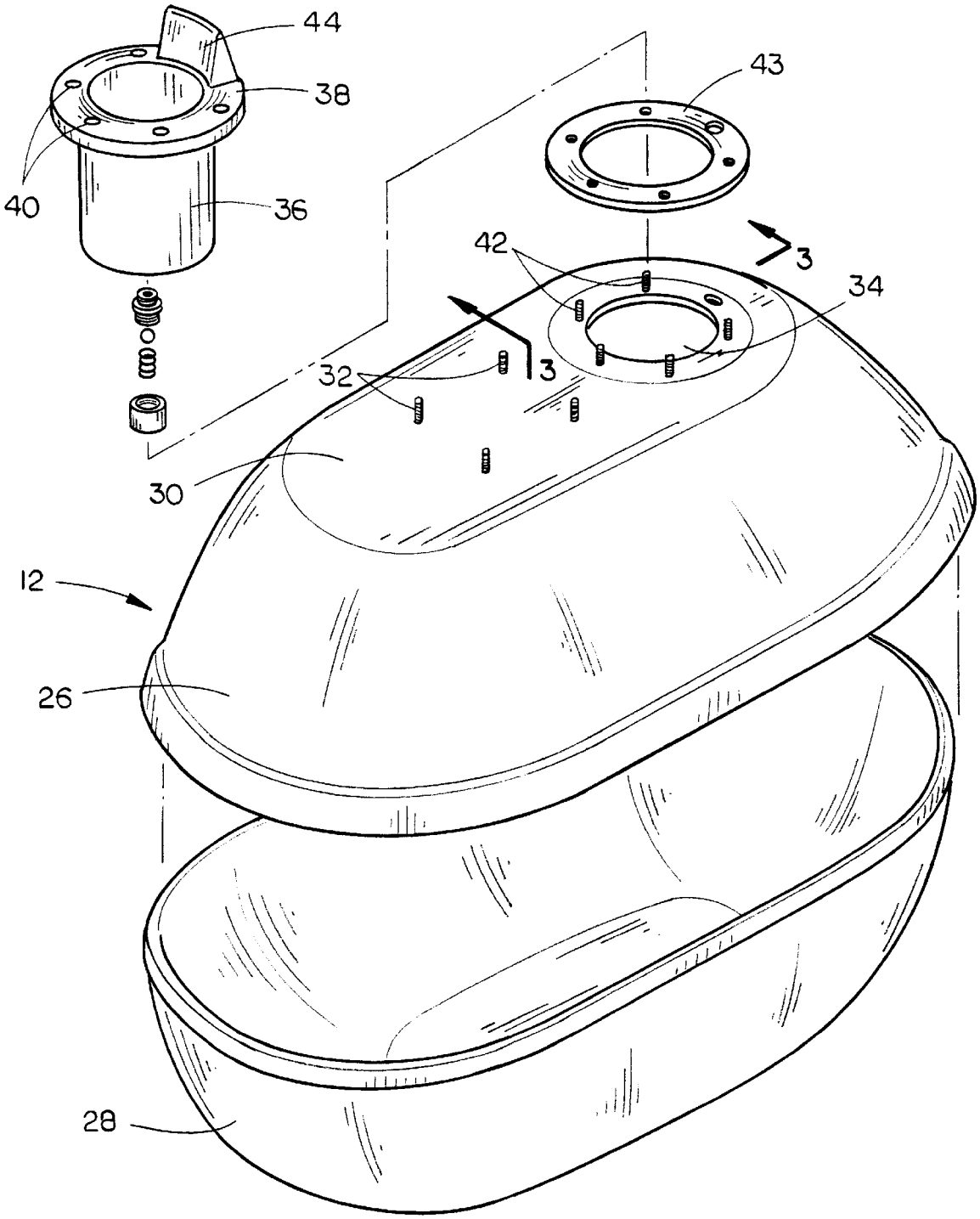
FIG. 2 is an exploded perspective view of the air compressor of the present invention, with the motor removed.

Referring now to FIG. 2, it can be seen that tank 12 is formed of upper and lower clamshells 26 and 28, respectively, the use of the clamshell shape permits the formation of a flat upper wall 30 on upper clamshell 26, which in turn permits direct attachment of the motor base 18 (shown in FIG. 1) on threaded studs 32 projecting through upper wall 30. Upper clamshell 26 is mounted to lower clamshell 28 using a single continuous weld.

A hole 34 is formed in upper wall 30 for receiving cylinder 36 therein. Cylinder 36 has a flange 38 projecting radially outwardly from the upper end thereof, with a plurality of spaced apart bolt hole 40 therethrough which will align with threaded studs 42 surrounding hole 34 on upper wall 30 of tank 12. A gasket 43 is provided for a secure seal between flange 38 and tank upper wall 30.

A manifold 44 is formed on the upper surface of flange 38, for a purpose described in more detail hereinbelow.

Figure 3:
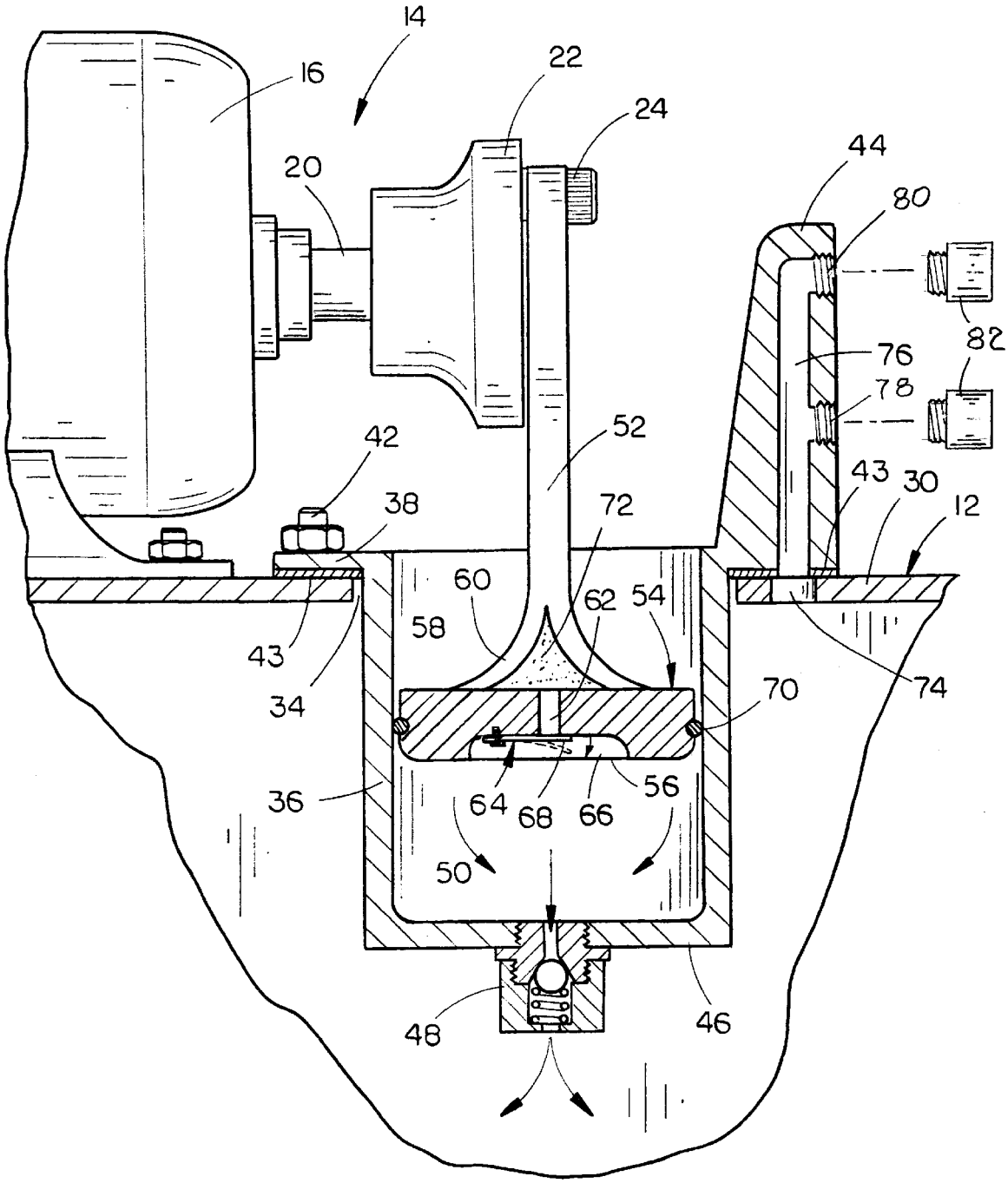
FIG. 3 is an enlarged sectional view taken at lines 3—3 in FIG. 2.

Referring now to FIG. 3, cylinder 36 has a bottom wall 46 enclosing the lower end thereof. A check valve 48 is mounted in a port 50 formed in bottom wall 46, to permit air flow into tank 12 from the interior of cylinder 36, but prevent air flow out of tank 12 through port 50.

Piston rod 52 is rotatably connected at its upper end to pin 24 on eccentric 22, such that rotation of eccentric 22 will cause piston rod 52 to reciprocate vertically within cylinder 36. An enlarged head 54 is formed on the lower end of piston rod 52, with a flat bottom 56, a cylindrical side wall 58, and a generally conic upper surface 60, tapering into the diameter of rod 52. An aperture 62 is formed through piston rod head 54, extending upwardly from the bottom 56, through the head 54 and generally transversely outwardly through the conic upper surface 60. A reed valve 64 is provided within a groove or depression 66 in the bottom 56 of head 54, for selectively closing aperture 62. Reed valve 64 includes a thin, flexible reed 68 which is formed in a straight, normally-closed position, covering aperture 62. As the piston rod 52 begins its upward stroke, two forces will combine to flex reed 68 downwardly away from aperture 62, to permit air flow into the interior of cylinder 36. First, the vacuum formed below the piston rod head 54 and cylinder bottom wall 46 will cause air pressure within aperture 62 to force reed 68 downwardly. In addition, the physical motion of the upward vertical stroke of the piston rod 52 will cause the inertial force of the mass of reed 68 to pull the reed downwardly. An annular seal ring 70 on head side wall 58 prevents air from escaping around piston head 54, such that the downward stroke of piston rod 52 will force air through check valve 48 and into tank 12.

Preferably, the conic shape of the upper surface of head 54 is hollowed out to permit the installation of an air filter 72 therein. This permits the filtering of intake air as it is drawn into cylinder 36 and then compressed into tank 12.

An exhaust port 74 is formed in tank upper wall 30 immediately adjacent hole 34, and directly under manifold 44, and will communicate through an aperture in gasket 43 to an exhaust passageway 76 in manifold 44. A plurality of threaded ports 78 and 80 communicate with passageway 76, to permit attachment of various gages, hoses valves, 82 or other desired equipment for the selective dispensing of compressed air from tank 12.

Whereas the invention has been shown and described in connection with the preferred embodiment thereof, many modifications, substitutions and additions may be made which are within the intended broad scope of the appended claims.

I claim:

1. An air compressor, comprising:

an air storage tank having an upper wall;

a drive motor with a drive shaft, mounted on the tank upper wall;

an eccentric mounted on the drive shaft, with a projecting pin for reciprocating a piston rod;

a hollow cylinder having a closed lower end and an open upper end, mounted in the tank upper wall with the cylinder lower end located within the interior of the tank;

an intake port formed in the lower end of the cylinder, with an operable valve mounted in the port and operable to permit air flow into the tank but prevent air flow out of the tank;

a piston rod having upper and lower ends, the upper end rotatably connected to the eccentric pin, and the lower end having a piston head slidably jouraled within the cylinder for reciprocating movement therein;

an aperture formed through the piston rod head for air flow therethrough, and an operable valve mounted in the aperture and operable to permit air flow into the cylinder but prevent air flow out of the cylinder; and an exhaust port formed in the tank, and an operable valve connected thereto, operable to selectively permit air flow out of the tank.

2. The compressor of claim 1, wherein the tank is a two piece clamshell tank with a single continuous weld connecting upper and lower clamshell halves.

3. The compressor of claim 2, wherein said upper clamshell is formed with a flat upper wall, upon which the motor is mounted.

4. The compressor of claim 3, wherein said piston head has a substantially cylindrical side wall with seal means projecting radially outwardly therefrom in sealed contact with the cylinder side wall.

5. The compressor of claim 4, wherein the piston head has a bottom and a generally conic upper surface gradually tapering into the surface of the rod, said piston head aperture extending from the bottom, through the head and out generally transversely through the conic surface.

6. The compressor of claim 5, wherein the piston head bottom has a depression formed therein, and wherein said piston rod valve is operably mounted in the depression.

7. The compressor of claim 6, wherein said piston rod valve is a reed valve, with a flexible reed selectively covering the aperture to prevent air flow therethrough.

8. The compressor of claim 7, wherein the reed in the reed valve is positioned in a straight, flat position covering the aperture in its normal, at rest position.

9. The compressor of claim 8, further comprising filter material mounted in the piston rod aperture, for filtering air passing through the aperture.

10. The compressor of claim 9, wherein said cylinder includes a flange projecting radially outwardly therefrom secured to said tank.

11. The compressor of claim 10, further comprising a manifold having an air passageway therethrough, mounted on said flange, and said tank having an exhaust port formed in the upper wall thereof aligned with the manifold passageway.

12. The compressor of claim 11, wherein said manifold has a plurality of ports connected to said passageway.

13. The compressor of claim 1, wherein the piston head has a bottom and a generally conic upper surface gradually tapering into the surface of the rod, said piston head aperture extending from the bottom, through the head and out generally transversely through the conic surface.

14. The compressor of claim 13, wherein the piston head bottom has a depression formed therein, and wherein said piston rod valve is operably mounted in the depression.

15. The compressor of claim 14, wherein said piston rod valve is a reed valve, with a flexible reed selectively covering the aperture to prevent air flow therethrough.

16. The compressor of claim 1, further comprising filter material mounted in the piston rod aperture, for filtering air passing through the aperture.

17. The compressor of claim 1, wherein said cylinder includes a flange projecting radially outwardly therefrom secured to said tank.

18. The compressor of claim 17, further comprising a manifold having an air passageway therethrough, mounted on said flange, and said tank having an exhaust port formed in the upper wall thereof aligned with the manifold passageway.

19. In combination:

a hollow cylinder having a closed lower end and an open upper end;

said lower end having a port formed therein with a check valve in the port operable to permit air flow out of the cylinder and prevent air flow into the cylinder; and a piston rod having upper and lower ends, the upper end having means for connecting the rod to a drive motor for reciprocating the rod;

the rod lower end having an enlarged head slidably journaled within the cylinder; said head having an aperture formed therethrough, and an operable valve in the aperture operable to permit air flow into the cylinder and prevent air flow out of the cylinder;

said piston head having a bottom, and having a generally conic upper surface tapering into the surface of the rod, said piston head aperture extending generally centrally from the bottom through the head and out generally transversely through the conic surface.

20. The combination of claim 19, wherein the piston head bottom has a depression formed therein, wherein the piston head aperture is located within the depression, and wherein said piston rod valve is operably mounted in the depression.

21. The combination of claim 19, further comprising filter material mounted in the piston rod aperture, for filtering air passing through the aperture.

22. In combination:

an air storage tank;

a hollow cylinder having a closed lower end and an open upper end, mounted in said tank with the cylinder lower end located within the interior of the tank;

an intake port formed in the lower end of the cylinder, with an operable valve mounted in the port and operable to permit air flow into the tank and prevent air flow out of the tank;

an air pump mounted on the tank, having a piston slidably mounted in the cylinder for reciprocation therein;

an exhaust port formed in the tank proximal to the cylinder; and a manifold having an air passageway therethrough, mounted in the upper end of the cylinder, with said air passageway in alignment with the tank exhaust port.

23. The combination of claim 22, wherein said cylinder upper end has a flange projecting radially outwardly therefrom, said flange secured to the tank, and said manifold mounted on the flange.

24. The combination of claim 22, wherein said manifold has a plurality of ports connected to the passageway.

* * * * *